United States Patent [19]

Cox

[11] 3,935,830

[45] Feb. 3, 1976

[54] BOW PULPIT MOUNTED PIVOTING FLUKE TYPE ANCHOR HOLDER

[76] Inventor: Richard D. Cox, 47163 Ayers, Belleville, Mich. 48111

[22] Filed: Sept. 30, 1974

[21] Appl. No.: 510,358

[52] U.S. Cl. ..... 114/210; 248/251

[51] Int. Cl.[2] ..... B63B 21/22

[58] Field of Search ..... 114/206 R, 207, 208 R, 114/210, 221 R; 248/230, 267, 266, 251; 242/55.2; 9/1 R

[56] References Cited

UNITED STATES PATENTS

| | | | |
|---|---|---|---|
| 758,216 | 4/1904 | Reiss et al. | 248/267 |
| 973,319 | 10/1910 | Thunen et al. | 248/230 |
| 1,836,727 | 12/1931 | Rathe | 248/267 |
| 2,030,960 | 2/1936 | Burns | 248/267 |
| 2,705,467 | 4/1955 | Ogg et al. | 114/221 R |
| 2,905,126 | 9/1959 | Gaffey | 9/1 R |
| 3,143,993 | 8/1964 | Salerno | 114/210 |
| 3,291,093 | 12/1966 | Wood | 114/208 R |
| 3,307,710 | 3/1967 | Negri | 248/230 |
| 3,752,107 | 8/1973 | Tuyl | 114/210 |
| 3,785,323 | 1/1974 | Lantz | 114/210 |

*Primary Examiner*—Trygve M. Blix
*Assistant Examiner*—Charles E. Frankfort
*Attorney, Agent, or Firm*—Joseph R. Papp

[57] ABSTRACT

A pair of brackets movably attached to a rail defining a pulpit at the bow of a boat for removably securing at the bow an anchor of the pivoting fluke type, the anchor having a pair of flukes connected to a rod which extends beyond the flukes, each of the brackets having a structure for securing it to the rail and each having apparatus for removably securing the anchor at the opposite ends of the rod.

21 Claims, 5 Drawing Figures

BOW PULPIT MOUNTED PIVOTING FLUKE TYPE ANCHOR HOLDER

SUMMARY BACKGROUND OF THE INVENTION

The present invention relates to apparatus for removably securing an anchor of the pivoting fluke type to the bow pulpit of a boat.

A pivoting fluke type anchor (often referred to as a Danforth anchor) is a commonly used anchor on small and medium sized sail boats and power boats. On sail boats where there is a limitation on space, storage of the anchor has been a problem. While deck mountings have been utilized to fix the anchor during non use, it may be difficult to find a portion of the deck near the bow for location of such mounting. One such mounting is shown in the United States Patent to R. D. Ogg et al, U.S Pat. No. 2,705,467 issued Apr. 5, 1955. Note that a pivoting fluke (Danforth) type anchor is illustrated in FIG. 1 of that patent and reference to other patents dealing with similar anchor structures is made in the patent, all of which are adopted herein by reference.

In many sail boats there is a rail at the bow of the boat defining a pulpit. The rail provides support for the sailor when he is required to perform various tasks at the bow. In the present invention, a pair of brackets have been provided which can be movably secured to the pulpit rail whereby the pivoting fluke type (Danforth) anchor can be removably secured at a location outboard of the boat. With this structure the anchor is still readily accessible when needed and yet is located off of the deck and is out from underfoot. Therefore, it is an object of the present invention to provide apparatus for securing a pivoting fluke type anchor to the pulpit rail of a boat.

The pulpit rails for different boats will vary in configuration. The mounting brackets of the present invention are designed such that they can be adjusted to accommodate a large variety of rail shapes. Therefore, it is another object of the present invention to provide a mounting bracket of the above described type which is readily adjustable to accommodate different rail shapes.

It is another general object to provide an improved mounting for an anchor of the pivoting fluke type.

Other objects, features, and advantages of the present invention will become apparent from the subsequent description and the appended claims, taken in conjunction with the accompanying drawing, in which:

Figure 1:
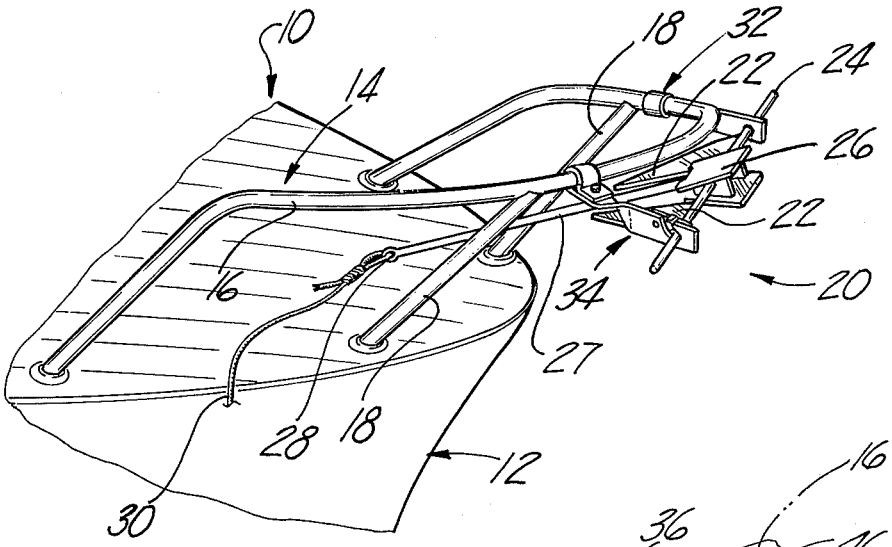
FIG. 1 is a fragmentary pictorial view of the bow pulpit with the brackets of the present invention mounted on the pulpit rail and securing a pivoting fluke type anchor thereto.
Figure 2:
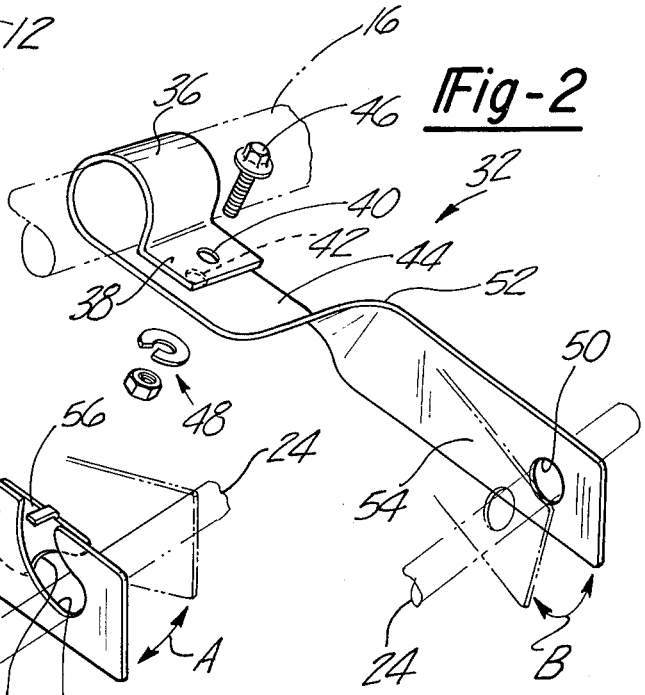
FIG. 2 is a pictorial view of one of the brackets.
Figure 3:
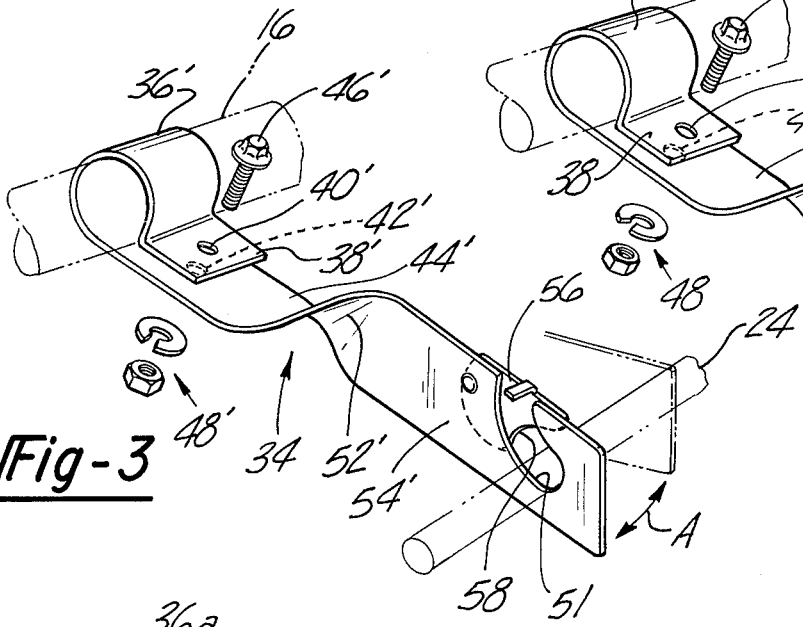
FIG. 3 is a pictorial view of the other of the brackets.

Looking now to FIGS. 1–3, a boat 10 (partially shown) haas a bow 12. A rail assembly 14 is secured to the bow 12 and defines what is commonly referred to as "the bow pulpit." The rail assembly 14 can be in a variety of configurations and in the form shown in FIG. 1 has a curved upper rail 16 and a pair of vertical support rails 18.

The pulpit rail 14 normally serves as a guardrail for the sailor working at the bow 12. In the present invention, the pulpit rail 14 is also used to hold the anchor during non-use. Thus in FIGS. 1–3 a pivoting fluke type anchor 20 is shown. Anchor 20 includes a pair of flukes 22 attached to a rod or stock 24; a crown plate assembly 26 is secured to the rear of flukes 22 and at the rod 24. A shank 27 is hingedly connected at its rearward end to the rod or stock 24 between the sides of the crow plate assembly 26. The forward end of shank 27 is provided with suitable means 28 for attachment to a cable 30.

A pair of support brackets 32 andd 34 are movably secured to the upper rail 16 and serve to hold the anchor 20 in a position off of the deck and generally outboard of the boat 10.

Bracket 32 is of a one piece structure made of a resilient, deformable material such as steel. The bracket 32 can be made from steel strap and is formed with a clamping portion 36 at its inner end. Clamping portion 36 is formed into a generally circular shape terminating in a flat portion 38. The clamping portion 36 has a circular contour similar to the upper rail 16 and hence will snugly receive the rail 16. A pair of aligned openings 40 and 42 are located in the flat portion 38 and the confronting flat portion 44 below and are adapted to receive a bolt 46; a nut and washer assembly 48 can be located on the bolt 46 and the clamping portion 36 tightened to securely clamp the bracket 32 at the desired location along the upper rail 16.

The opposite or forward end portion 54 of the bracket 32 is provided with an opening 50 which is adapted to receive the end of the anchor rod 24. In order to support the anchor 20 with rod 24 somewhat horizontal (as shown in the drawings) it is required that the axis of the opening 50 be generally in spaced parallelism with the axis of the generally circular clamping portion 36. This is accomplished by permanently twisting the bracket 32 approximately 90° at a selected location 52 whereby the plane of the forward portion 54 (with opening 50) of bracket 32 extends generally centrally from and transversely to the plane of the rearward portion, i.e., portions 38 and 44.

The bracket 34 is similar to bracket 32 and hence like components have been given like numbers with the addition of a prime. The forward portion 54′ of bracket 34, however, is different from portion 54 of bracket 32 and is formed with an arcuately extending slot 51. Slot 51 is of a size to receive the opposite end of the anchor rod 24. A locking plate 56 is pivotally secured to the flat portion 54′ at a location such that it can be pivoted into and out of the entrance to slot 51.

In use then, the anchor 20 can be mounted first by locating the one end of the anchor rod 24 in the opening 50. Opening 50 is oversize sufficiently to permit some angulation of the anchor 20 during assembly. Next the locking plate 56 is pivoted away from the entrance to slot 51 and the opposite end of the anchor rod 24 is located therein. The locking plate 56 is then pivoted to its closed position. The plate 56 has a cam portion 58 which is located to engage the rod 24. As the rod 24 is moved, i.e., as a result of vibration, etc., in a direction out from the slot 51, it will engage the cam surface 58 which will tend to pivot the locking plate 56 closed. This self locking feature prevents the anchor 20 from being dislodged inadvertently. To remove the anchor 20, the locking plate 56 is first pivoted out from the entrance to slot 51 and then the anchor rod 24 can be removed from the slot 51 and opening 50.

Because of the shape and curvature of rails, such as upper rail 16, vary, the brackets 32 and 34 are constructed to accommodate these variations. Firstly, it has already been shown that the relative spacing between brackets 32 and 34 can be readily adjusted to fit different anchor sizes. In addition, it is important that the axis of opening 50 and that of the slot 51 be aligned. The curvature of the rail 16, however, might be such as to cause the planes of the flat portions 54 and 54' to diverge in what would be a horizontal direction in FIGS. 1–3. This divergence can be easily corrected by simply bending the flat portions 54 and 54' towards each other in the direction of arrows A (displaced position shown in phantom in FIG. 3). The twisted portions 52, 52' facilitate the bending.

There could also be a divergence of the planes of portions 54 and 54' in what would be a vertical direction in FIGS. 1–3. This can be easily corrected by simply twisting, or untwisting portions 54 and 54' in the direction of arrows B (displaced position shown in phantom in FIG. 2) about their respective twisted portions 52 and 52' until the axes of opening 50 and slot 51 are aligned.

Thus the brackets 32 and 34 are of a simple construction and are readily adaptible to accommodate different anchor sizes and various shaped and contoured railings.

Figure 4:
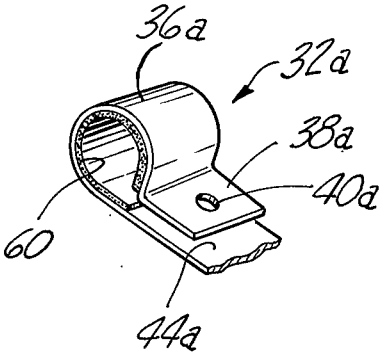
FIG. 4 is a fragmentary view showing another form of assembly utilizing a split sleeve between the bracket and the pulpit rail.

A modified form of the invention is shown in FIG. 4. In the discussion of FIG. 4 components similar to like components in FIGS. 1–3 have been given the same numerical designation with the addition of the letter postscript *a*. In FIG. 4 a split ring 60 of an elastomeric or otherwise flexible non-metallic material is located in the circular clamping portion 36*a*. The use of the flexible ring 60 can prevent corrosion, i.e., frettage from metal to metal contact, etc., and also will permit the accommodation of a greater variation in rail shape and size.

Figure 5:
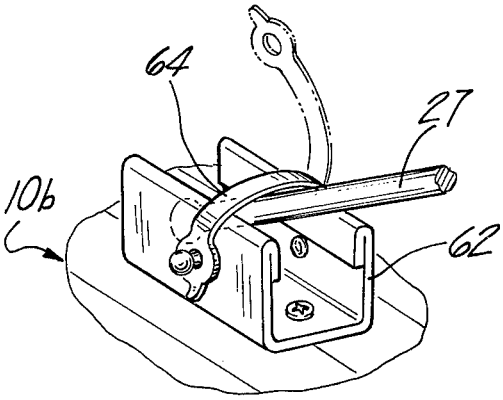
FIG. 5 is a fragmentary view of an additional bracket to tie down the shank of the anchor.

In the embodiment of FIGS. 1–3 the shank 27 can be permitted to stand freely or could be tied via cable 30. In the embodiment of FIG. 5, the forward end of shank 27 is secured to a bracket 62 mounted on the deck. The bracket 62 is U-shaped and has attached an elastomeric strap 64 which holds the shank 27 secure. Again in FIG. 5 components similar to like components in FIG. 1–3 are given the same numerical designation with the addition of the letter *b* postscript.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. In a boat having a railing mounted thereon, apparatus for mounting a pivoting fluke type anchor where the anchor includes a pair of flukes connected to a rod with each end of the rod extending beyond the flukes and including an elongated shank and means pivotally connecting the shank to the rod and flukes, said apparatus comprising: first holding means for removably supporting the anchor at one end of the rod and flukes, second holding means for removably supporting the anchor at the opposite end of the rod and flukes, and securing means for securing said first and second holding means to the rail, said securing means including first and second securing means for independently securing said first and second holding means to the rail at movably selected positions relative to each other.

2. In a boat having a railing mounted thereon, apparatus for mounting a pivoting fluke type anchor where the anchor includes a pair of flukes connected to a rod with each end of the rod extending beyond the flukes and including an elongated shank and means pivotally connecting the shank to the rod and flukes, said apparatus comprising: first holding means for removably supporting the anchor at one end of the rod and flukes, second holding means for removably supporting the anchor at the opposite end of the rod and flukes, and securing means for securing said first and second holding means to the rail, said first holding means including a first opening adapted to receive the one end of the rod and with said second holding means including a second opening separate from said first opening and adapted to receive the other end of the rod, said first and second holding means including means for locking the rod within said first and second openings.

3. The apparatus of claim 2 with said first holding means comprising first ajustment means for selectively adjusting the position of said first opening and said second holding means comprising second adjustment means for selectively adjusting the position of said second opening whereby said first and second openings can be located in axial alignment with each other.

4. The apparatus of claim 2 wherein said securing means including first and second securing means for independently securing said first and second holding means to the rail at movably selected positions relative to each other.

5. In a boat having a railing mounted thereon, apparatus for mounting a pivoting fluke type anchor where the anchor includes a pair of flukes connected to a rod with each end of the rod extending beyond the flukes and including an elongated shank and means pivotally connecting the shank to the rod and flukes, said apparatus comprising: first holding means for removably supporting the anchor at one end of the rod and flukes, second holding means for removably supporting the anchor at the opposite end of the rod and flukes, and securing means for securing said first and second holding means to the rail, said first holding means comprising a first bracket, said securing means comprising a first clamp assembly located at one end of said first bracket and including a generally circular first clamp portion adapted to clampingly engage the rail at a selected location, said first bracket having a first opening located at its opposite end with the axis of said first opening being approximately in spaced parallelism relative to the axis of said first circular clamp portion, said first opening adapted to receive the one end of the rod, said first holding means including means for locking the one end of the rod within said first opening.

6. The apparatus of claim 5 with said first bracket including first adjustment means selectively operable for varying the position of the axis of said first opening relative to the axis of said first circular clamp portion.

7. The apparatus of claim 6 with said second holding means comprising a second bracket, said securing means comprising a second clamp assembly located at one end of said second bracket and including a generally circular second clamp portion adapted to clampingly engage the rail at a selected location, said second bracket having a second opening located at its opposite end with the axis of said second opening being approximately in spaced parallelism relative to the axis of said second circular clamp portion said second opening adapted to receive the opposite end of the rod.

8. The apparatus of claim 7 with said second bracket including second adjustment means selectively operable for varying the position of the axis of said second opening relative to the axis of said second circular clamp portion.

9. The apparatus of claim 8 with said first opening being a slot, said locking means including releaseable locking plate means actuable for locking the one end of the rod in said slot.

10. The apparatus of claim 8 with said first and second brackets being made of a resilient, selectively deformable material, said first and second adjustment means including first and second twisted portions, respectively, located intermediate the ends of said first and second brackets, respectively.

11. In a boat having a deck and a railing mounted thereon, apparatus for mounting a pivoting fluke type anchor where the anchor includes a pair of flukes connected to a rod with each end of the rod extending beyond the flukes and including an elongated shank and means pivotally connecting the shank to the rod and flukes, said apparatus comprising: a first bracket made of a resilient, selectively deformable material, said first bracket including at one end a generally circular first clamp portion adapted to receive the rail, said first bracket including a first opening located at its opposite end with the axis of said first opening being approximately in spaced parallelism relative to the axis of said first circular clamp portion, said first bracket being constructed from a single, unitary strip of flat sheet-like stock with said first circular clamp portion being formed along the flat, said first bracket having a first twisted portion intermediate its ends twisted approximately 90° whereby the above defined axial relationship between said first opening and said first circular clamp portion is provided.

12. The apparatus of claim 11 with said apparatus comprising a second bracket made of a resilient, selectively deformable material, said second bracket including at one end a generally circular second clamp portion adapted to receive the rail, said second bracket including a second opening located at its opposite end with the axis of said first opening being approximately in spaced parallelism relative to the axis of said second circular clamp portion, said second bracket being constructed from a single, unitary strip of flat, sheet-like stock and said second circular clamp portion being formed along the flat, said second bracket having a second twisted portion intermediate to ends twisted approximately 90° whereby the above defined axial relationship between said second opening and said second circular clamp portion is provided.

13. The apparatus of claim 12 with said first and second openings being locatable in axial alignment with each other by rotation of said openings through twisting of said first and second twisted portions.

14. The apparatus of claim 13 with said first and second openings being locatable in axial alignment with each other by bending said first and second brackets between said first and second twisted portions, respectively, and said first and second openings, respectively.

15. The apparatus of claim 11 further comprising an elastomeric split sleeve located in said first circular clamp portion.

16. The apparatus of claim 11 with said first opening being a slot, said first bracket including releaseable locking plate means actuable for locking one end of the rod in said slot.

17. In a boat having a deck and having a pivoting fluke type anchor where the anchor includes a pair of flukes connected to a rod with each end of the rod extending beyond the flukes and including an elongated shank and means pivotally connecting the shank to the rod and flukes, the combination comprising: a railing mounted on the deck, a first bracket made of a resilient, selectively deformable material, said first bracket including at one end a generally circular first clamp portion adapted to receive the rail, said first bracket including a first opening located at its opposite end with the axis of said first opening being approximately in spaced parallelism relative to the axis of said first circular clamp portion, said first bracket being constructed from a single, unitary strip of flat sheet-like stock with said first circular clamp portion being formed along the flat, said first bracket having a first twisted portion intermediate its ends twisted approximately 90° whereby the above defined axial relationship between said first opening and said first circular clamp portion is provided.

18. The combination of claim 17 further comprising: a second bracket made of a resilient, selectively deformable material, said second bracket including at one end a generally circular second clamp portion adapted to receive the rail, said second bracket including a second opening located at its opposite end with axis of said first opening being approximately in spaced parallelism relative to the axis of said second circular clamp portion, said second bracket being constructed from a single, unitary strip of flat, sheet-like stock and said second circular clamp portion being formed along the flat, said second bracket having a second twisted portion intermediate its ends twisted approximately 90° whereby the above defined axial relationship between said second opening and said second circular clamp portion is provided.

19. The combination of claim 18 with said first and second openings being locatable in axial alignment with each other by rotation of said openings through twisting of said first and second twisted portions, with said first and second openings being locatable in axial alignment with each other by bending said first and second brackets between said first and second twisted portions, respectively, and said first and second openings, respectively.

20. The apparatus of claim 18 with said first opening being a slot, said first bracket including releaseable locking plate means actuable for locking one end of the rod in said slot.

21. The combination of claim 18 including channel means secured to the deck and adapted to receive the shank of the anchor.

* * * * *